US007568323B2

(12) United States Patent
Shelton et al.

(10) Patent No.: US 7,568,323 B2
(45) Date of Patent: Aug. 4, 2009

(54) LAP AND LOCK BEAM

(75) Inventors: William B. Shelton, Tampa, FL (US); William H. Crostic, Jr., Simpsonville, SC (US)

(73) Assignee: American Builders & Contractors Supply Co., Inc., Beloit, WI (US)

( * ) Notice: Subject to any disclaimer, the term of this patent is extended or adjusted under 35 U.S.C. 154(b) by 0 days.

(21) Appl. No.: 11/652,103

(22) Filed: Jan. 11, 2007

(65) Prior Publication Data

US 2008/0168738 A1 Jul. 17, 2008

(51) Int. Cl.
*E04C 3/00* (2006.01)

(52) U.S. Cl. ..... 52/844; 82/843; 82/579

(58) Field of Classification Search ..... 52/731.2, 52/730.5, 731.3, 580, 650.1, 732.1, 732.2, 52/63, 656.9, 489.2, 579, 731.5, 222, 839, 52/844, 843, FOR. 134, FOR. 130, FOR. 135, 52/FOR. 142, FOR. 143; 160/391, 392, 395
See application file for complete search history.

(56) References Cited

U.S. PATENT DOCUMENTS

| | | | | |
|---|---|---|---|---|
| 3,222,841 | A | 12/1965 | Lipof | |
| 4,905,442 | A * | 3/1990 | Daniels | 52/588.1 |
| 5,134,250 | A * | 7/1992 | Caveney et al. | 174/101 |
| 5,647,184 | A * | 7/1997 | Davis | 52/592.1 |
| 5,864,998 | A * | 2/1999 | Loomer | 52/271 |
| 5,904,022 | A | 5/1999 | Zadok | |
| 6,385,941 | B1 | 5/2002 | Power, Jr. | |
| 6,601,362 | B1 | 8/2003 | Prince | |
| 6,658,808 | B1 | 12/2003 | Doherty et al. | |
| 6,668,495 | B1 * | 12/2003 | Prince | 52/63 |
| 6,755,004 | B1 * | 6/2004 | Power et al. | 52/731.3 |
| 6,826,885 | B2 * | 12/2004 | Raskin et al. | 52/731.2 |
| 2003/0145555 | A1 * | 8/2003 | Raskin et al. | 52/731.3 |
| 2007/0266671 | A1 * | 11/2007 | Chromy | 52/731.3 |

FOREIGN PATENT DOCUMENTS

WO WO 2007/022542 * 2/2007

OTHER PUBLICATIONS

Jude Kleila (SET); Proposal Concept to AAF; Design and Analysis; Improved Design of Self Mating Beam Extrusions; 2 pages; Apr. 2006.

Armstrong Provisional Application; "Structural Beam"; 5 pages; Jul. 2006.

* cited by examiner

*Primary Examiner*—Robert J Canfield
*Assistant Examiner*—Jessie Fonseca
(74) *Attorney, Agent, or Firm*—Nixon & Vanderhye, PC

(57) ABSTRACT

Two U-shaped beam half sections are attached together by having nesting ledges/receptacles on the flanges of the half sections. While the flanges of each beam half overlap against each other, the nesting ledges/receptacles hold the beam half flanges to fixed locations. Fasteners such as screws can be driven through the sides of the beam half flanges to fixedly lock the beam half sections to one another.

10 Claims, 5 Drawing Sheets

LAP AND LOCK BEAM

BACKGROUND OF THE INVENTION

The present invention relates to a beam configuration for use in a frame of a screened enclosure, such as a patio or pool screen enclosure.

FIG. 1 is a perspective view of a basic screened enclosure 11 attached to another structure such as a house 12.

Most pool screen and screened enclosure applications use individual metal beams that must be assembled together. Each beam is comprised of half sections that are fitted to one another and then screwed or riveted.

FIG. 2 is a side cross-sectional view of two beam half sections 14,16 of a first prior art beam assembly. A common problem with the illustrated structure is keeping and supporting the beam half sections in the configuration shown in FIG. 2. For example, if beam half section 14 is positioned on top of beam half section 16, the legs or flanges 18,20 of upper beam half section 14 can fall in the direction of arrow A (FIG. 3) and no longer be adjacent the legs or flanges 22,24 of half beam section 16, as shown in FIG. 3.

A second example prior art beam assembly is illustrated in FIG. 4 and disclosed, for example, in U.S. Pat. No. 6,385,941, the disclosure of which is incorporated herein by this reference. The assembly illustrated in FIG. 4 addresses the slippage problems note above with reference to FIGS. 2 and 3. In the FIG. 4 structure, flange 36 of beam half section 28 abuts and is seated against angled lip 40 of beam half section 26 while flange 30 of beam half section 26 abuts and is seated against angled lip 38 of beam half section 28. On the other hand, flange 34 of beam half section 28 abuts to an exterior facing rib 42 of flange 30 of half beam section 26 and flange 32 of half beam section 26 abuts to exterior facing rib 44 of flange 36 of beam half section 28.

While the abutment end seating of flanges 30 and 36 respectively against inwardly angled lips 38,40, respectively, addresses the slippage in direction A mentioned with reference to FIG. 3, that is not to say that further improvement of the beam structure cannot be realized.

BRIEF DESCRIPTION OF THE INVENTION

The existing self mating beams used in the patio/pool enclosure industry tend to have a failure mode, in bending and axial loading, of buckling of the flanges of the beam half sections.

The invention provides for extra restraints to the flanges thus increasing the allowable loads before flange buckling will occur. Accordingly, the invention provides for an improved structural beam that provides increased strength of the beam.

Thus, the invention may be embodied in a beam assembly for defining a portion of a frame of a screened enclosure, comprising a first longitudinal half beam section having a first upper flange, a first lower flange, and first main portion connecting the first upper flange to the first lower flange; a first interior lip connected to an inside portion of the first upper flange, and forming a first interior receptacle with the first upper flange; a first exterior lip connected to an outside portion of the first lower flange, and forming a first exterior receptacle with the first lower flange; a second longitudinal half beam section having a second upper flange, a second lower flange, and second main portion connecting the second upper flange to the second lower flange; a second exterior lip connected to an exterior portion of the second upper flange, and forming a second exterior receptacle with the second upper flange; a second interior lip connected to an interior portion of the second lower flange, and forming a second interior receptacle with the second lower flange; wherein a free end edge of the first upper flange of the first longitudinal half beam is received in and restrained by the second exterior receptacle of the second longitudinal half beam while a free end edge of the first lower flange of the first longitudinal half beam is inserted into the second interior receptacle of the second longitudinal half beam, and wherein a free end edge of the second upper flange of the second longitudinal half beam is received in and restrained by the first interior receptacle of the first longitudinal half beam section while a free end edge of the second lower flange of the second longitudinal half beam section is inserted into the first exterior receptacle of the first longitudinal half beam section.

DETAILED DESCRIPTION OF THE INVENTION

Figure 1:
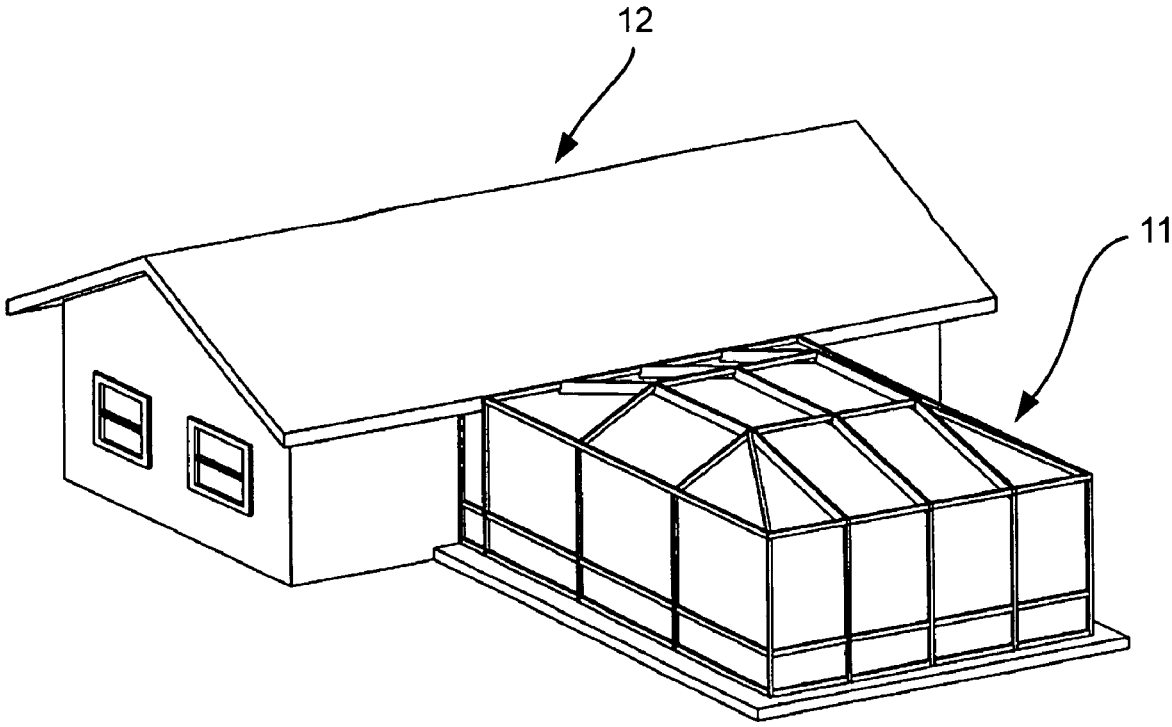
FIG. 1 (PRIOR ART)
FIG. 1 is a perspective view of a basic screened structure.
Figure 2:
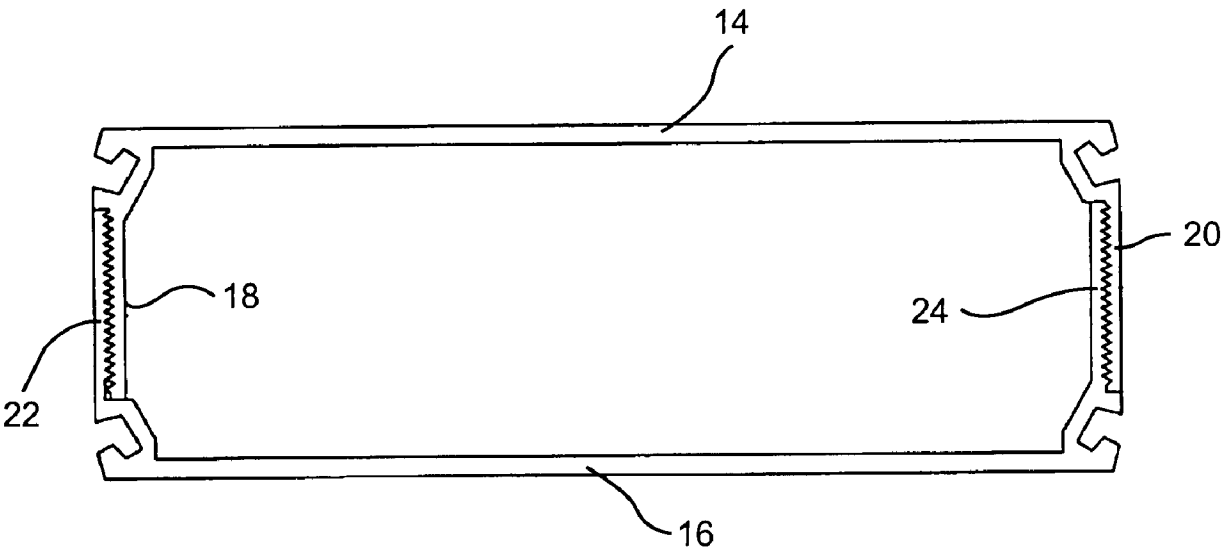
FIG. 2 (PRIOR ART)
FIG. 2 is a side-cross sectional view of two half beam sections of a first example prior art.
Figure 3:
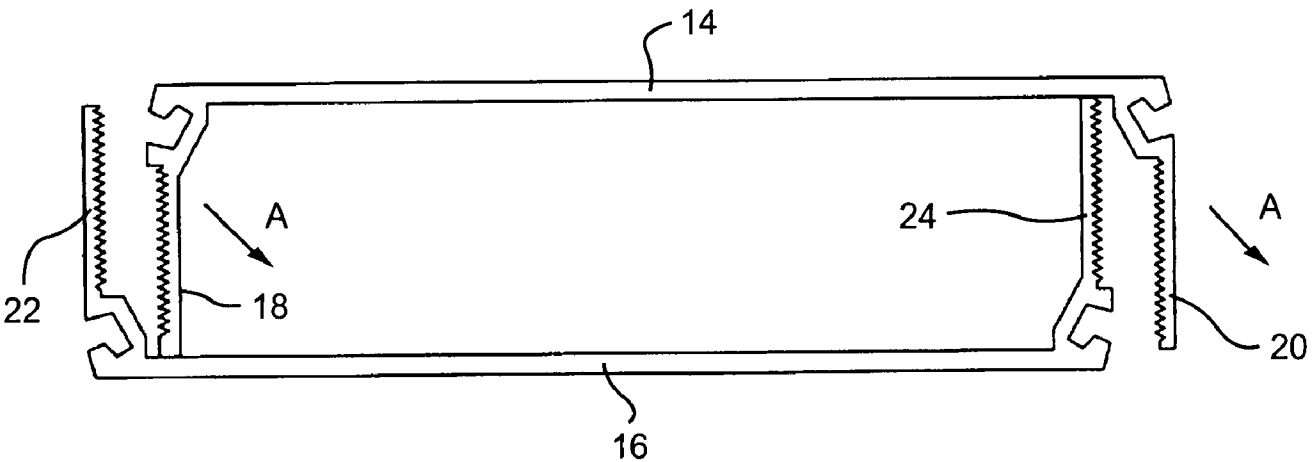
FIG. 3 (PRIOR ART)
FIG. 3 is a side-cross sectional view showing a slide problem of the beam half sections of FIG. 2.
Figure 4:
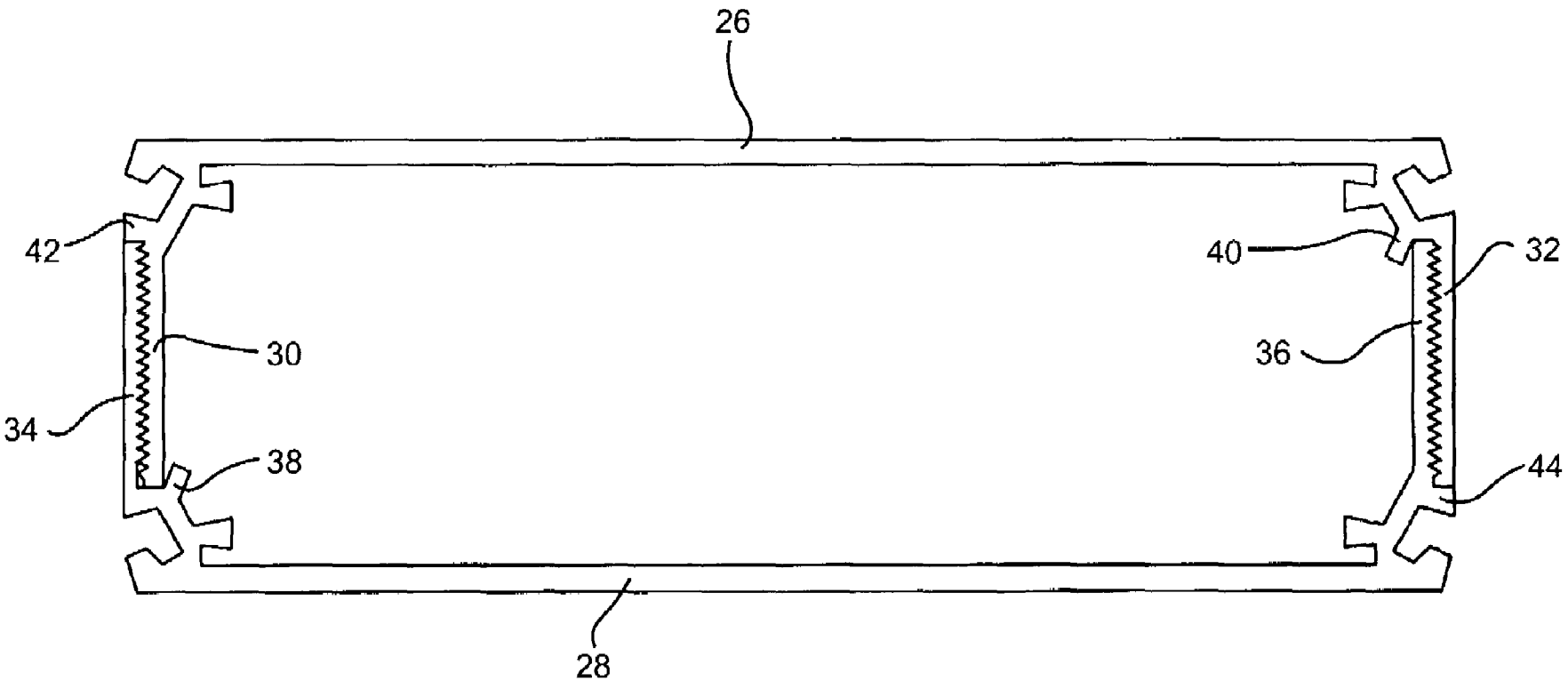
FIG. 4 (PRIOR ART)
FIG. 4 is a side cross-sectional view of a second example prior art beam section.

In the illustrated embodiments, each half beam section identically corresponds in shape and configuration to the beam half section with which it is engaged, overlapped, and locked. For ease of description, however, the respective beam half sections are assigned respective independent reference numerals as are the legs or flanges thereof.

In example embodiments of the invention, an extra restraint is provided in the form of a lip for receiving and engaging the free end of the exteriorly disposed flange of each of beam half section so that both the inner flange and outer flange of each beam half section abuts and is seated by a respective lip.

Figure 5:
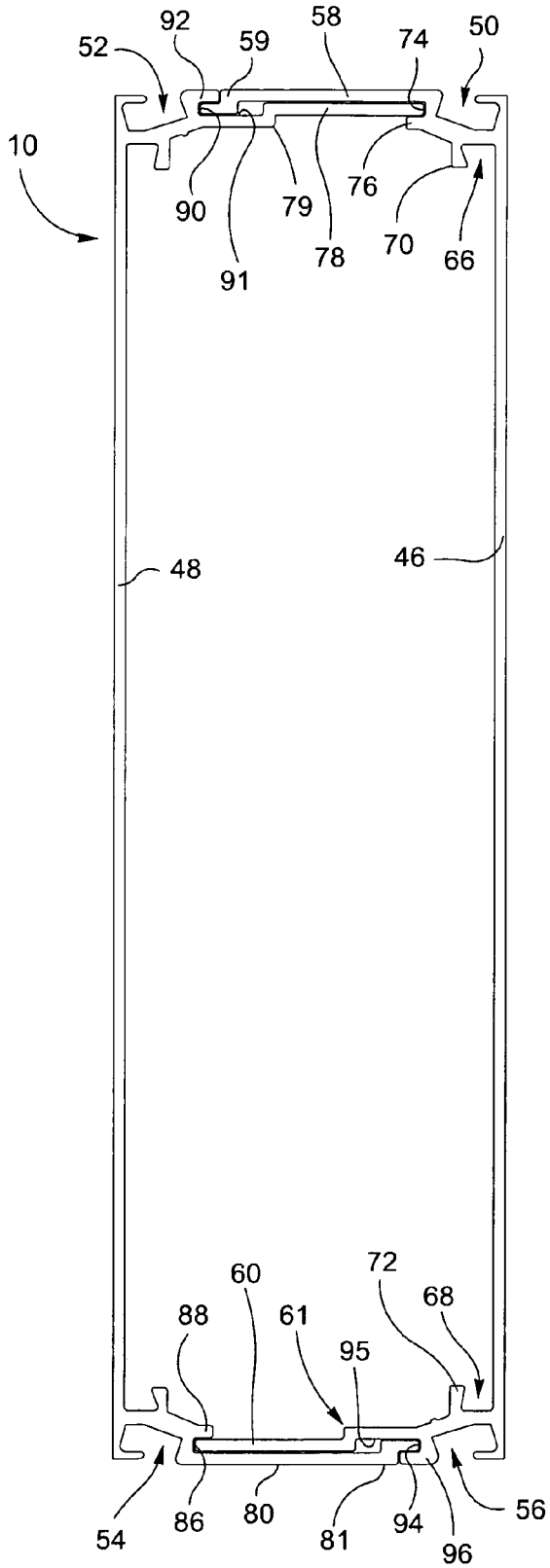
FIG. 5 is a side cross-sectional view of a first example beam assembly embodying the invention.

A first example embodiment of a beam assembly for a screened patio or pool enclosure is illustrated in FIG. 5. More specifically, in this embodiment the beam assembly includes two beam half sections 46,48. On the exterior of beam half sections 46,48 are grooves 50,52,54,56 for receiving spline that is used with screening of enclosures, which is not a part of the subject invention and is therefore not illustrated.

Beam half section 46 has flanges 58, 60, generally parallel to one another. Two U-shaped receptacles 66,68 face one another with prongs 70,72 having triangular shapes and located in the inside corners of the beam half section 46 adjacent the flanges 58,60. A nesting receptacle 74 and inner lip 76 are formed adjacent the inner corner where flange 58 meets the main section of beam half section 46. Likewise, beam half section 48 has flanges 78,80 generally parallel to one another. A nesting receptacle 86 and lip 88 is formed adjacent the inner corner of where flange 80 meets the main section of beam half 48.

In accordance with an example embodiment of the invention to fully rigidify the lapped and locked flanges of the beam half sections, a second nesting receptacle and lip is formed for engaging and holding the free end of the respectively outer flange of the beam half sections. Thus, as illustrated in FIG. 5, a nesting receptacle 90 and lip 92 are defined to receive and hold the free end edge of flange 58 and a nesting receptacle 94 and lip 96 are defined for engaging the free edge of flange 80. Thus, the free end edges of each of the flanges of the respective beam half sections are received in a respective nesting receptacle and locked therein by the respective lip.

In the illustrated example embodiment, flange 58 is stepped at 59 to define an abutment for lip 92. Likewise, flange 80 is stepped as at 81 to define an abutment step for engaging lip 96. The respective inner flanges of the beam half sections 46 and 48 are also stepped. More specifically, flange 78 is stepped at 79 and flange 60 is stepped at 61. It will be noted that the steps of the respective inner flanges 78 and 60 are remote from lips 76 and 88 respectively to effectively lock the stepped tip of the respective outer flanges 58 and 80 in a respective receptacle 91 and 95 defined by and between steps 79 and 61 and the nesting receptacles 90,94 and lips 92,96.

An installer of beam 10 can take beam half 46 and position flange 58 over flange 78 of beam half 48 while simultaneously positioning flange 60 adjacent to flange 80. By overlying the beam half sections 46,48, the end of flange 78 abuts against nesting lip/receptacle 74,76 while flange 60 abuts against nesting lip/receptacle 86,88. Further, the end of flange 58 abuts against lip/nesting receptacle 90,92 while flange 80 abuts against nesting lip/receptacle 94,96, and allows the installer to easily position the beam half sections together.

As mentioned above, U-shaped receptacles 66,68 are formed between two inwardly facing prongs 70,72 and the respective wall 46 of the beam for receiving one end of a connection plate (not illustrated). The aforementioned connecting plates slid into U-shaped receptacles 66,68 allow beam 10 to be connected to an axially adjacent beam. Additionally, although not illustrated, respectively adjacent flanges 58,78,60,80 of beam half sections 46,48 may be secured together by screwing fastener screws therethrough.

Figure 6:
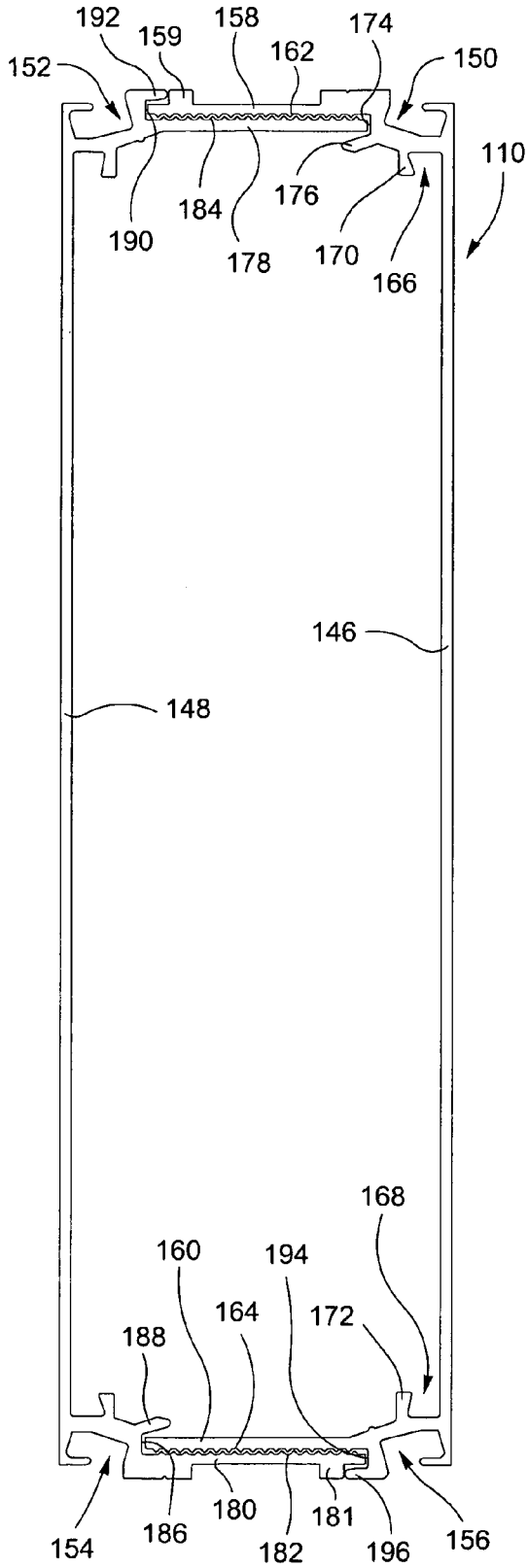
FIG. 6 is a side cross-sectional view of a second example beam assembly embodying the invention.

A second example embodiment of a beam assembly for a screened patio or pool enclosure is illustrated in FIG. 6. More specifically, in this embodiment the beam assembly includes two beam half sections 146,148. On the exterior of beam half sections 146,148 are grooves 150,152,154,156 for receiving spline that is used with screening of enclosures, which is not a part of the subject invention and is therefore not illustrated.

Beam half section 146 has flanges 158,160, generally parallel to one another with grooved surface 162 on the interior surface of flange 158 and a grooved surface 164 on the exterior of flange 160. Two U-shaped receptacles 166,168 face one another with prongs 170,172 having triangular shapes and located in the inside corners of the beam half section 146 adjacent the flanges 158,160. A nesting receptacle 174 and inwardly angled lip 176 is formed adjacent the inner corner where flange 158 meets the main section of beam half section 146. Likewise, beam half section 148 has flanges 178,180 generally parallel to one another with groove surface 182 on the interior surface of flange 180 and groove surface 184 on the outer surface of flange 178. A nesting receptacle 186 and inwardly angled lip 188 are formed adjacent the inner corner of where flange 180 meets the main section of beam half 148.

As noted above, in accordance with example embodiments of the invention, to fully rigidify the lapped and locked flanges of the beam half sections, a second nesting receptacle and lip is formed for engaging and holding the free end of the respectively outer flange of the beam half sections. Thus, as illustrated in FIG. 6, a nesting receptacle 190 and lip 192 are defined to receive and hold the free end edge of flange 158 and a nesting receptacle 194 and lip 196 are defined for engaging the free edge of flange 180. As illustrated, the inner surface of, e.g., lip 192 is tapered so that the entry end of receptacle 190 is enlarged. Thus, the free end edges of each of the flanges of the respective beam half sections are received in a respective nesting receptacle and locked therein by the respective lip.

In the illustrated example embodiment, flange 158 has a rib 159 to define an abutment surface for the lip 192. Likewise, flange 180 has a rib 181 to define an abutment step for engaging lip 196. As illustrated in FIG. 6, each rib 159, 181 projects outwardly from the respective flange so as to have first and second lateral sides, one of which defines the stepped surface that engages the respective exterior lip 192, 196, and an outer surface substantially coplanar with an outer surface of the respective exterior lip. As also understood from FIG. 6, each rib 159, 181 has a width between the first and second lateral sides thereof that is substantially less than the corresponding dimension of the respective flange.

An installer of beam 110 can take beam half 146 and position flange 158 over flange 178 of beam half 148 while simultaneously positioning flange 160 adjacent to flange 180. By overlying the beam half sections 146,148, the end of flange 178 abuts against nesting receptacle/lip 174,176 while flange 160 abuts against nesting receptacle/lip 186,188. Further, the end of flange 158 abuts against nesting receptacle/lip 190,192 while flange 180 abuts against nesting receptacle/lip 194,196, and allows the installer to easily position the beam half sections together.

As mentioned above, U-shaped receptacles 166,168 are formed between two inwardly facing prongs 170,172 and the respective wall 146 of the beam for receiving one end of a connection plate (not illustrated). The aforementioned connecting plates slid into U-shaped receptacles 166,168 allow beam 110 to be connected to an axially adjacent beam. Additionally, although not illustrated, respectively adjacent flanges 158,178,160,180 of beam half sections 146,148 may be secured together by screwing fastener screws therethrough.

Figure 7:
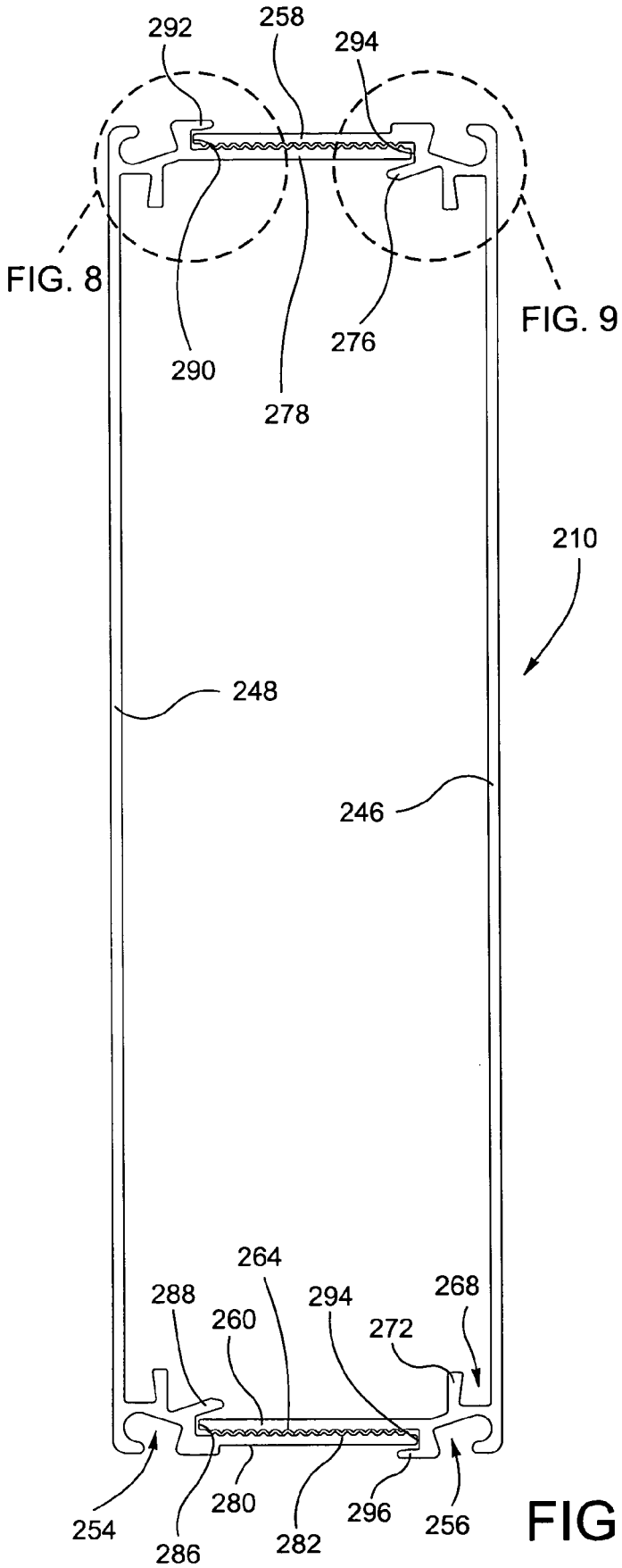
FIG. 7 is a side cross-sectional view of a third example beam assembly embodying the invention.
Figure 8:
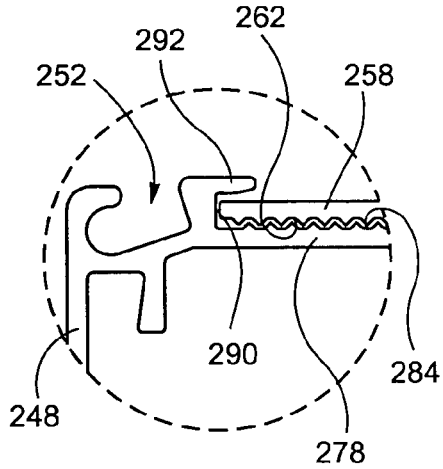
FIG. 8 is an enlarged view of a first corner detail of FIG. 7.
Figure 9:
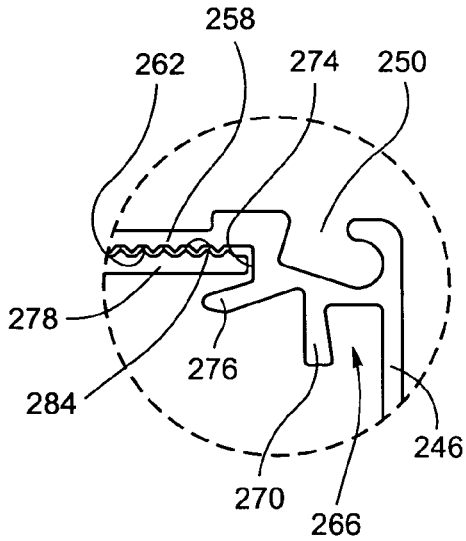
FIG. 9 is an enlarged view of a second corner detail of FIG. 7.

A third example embodiment of a beam assembly for a screened patio or pool enclosure is illustrated in FIG. 7. More specifically, in this embodiment the beam assembly includes two beam half sections 246,248. On the exterior of beam half sections 246,248 are grooves 250,252,254,256 for receiving spline that is used with screening of enclosures, which is not a part of the subject invention and is therefore not illustrated.

Beam half section 246 has flanges 258, 260, generally parallel to one another with grooved surface 262 on the interior surface of flange 258 and a grooved surface 264 on the exterior of flange 260. Two U-shaped receptacles 266,268 face one another with prongs 270,272 having triangular shapes and located in the inside corners of the beam half section 246 adjacent the flanges 258,260. A nesting receptacle 274 and inwardly angled lip 276 is formed adjacent the inner corner where flange 258 meets the main section of beam half section 246. Likewise, beam half section 248 has flanges 278,280 generally parallel to one another with grooved surface 282 on the interior surface of flange 280 and grooved surface 284 on the outer surface of flange 278. A nesting receptacle 286 and inwardly angled lip 288 are formed adjacent the inner corner of where flange 280 meets the main section of beam half 248.

As noted above, in accordance with example embodiments of the invention to fully rigidify the lapped and locked flanges of the beam half sections, a second nesting receptacle and lip is formed for engaging and holding the free end of the respectively outer flange of the beam half sections. Thus, as illustrated in FIG. 7, a nesting receptacle 290 and lip 292 are defined to receive and hold the free end edge of flange 258 and a nesting receptacle 294 and lip 296 are defined for engaging the free edge of flange 280. As illustrated, the inner surface of, e.g., lip 292 is tapered so that the entry end of the receptacle 290 is enlarged. Likewise, an inner surface of lip 296 is tapered so that the entry end of receptacle 294 is enlarged. Thus, the free end edges of each of the flanges of the respective beam half sections are received in a respective nesting receptacle and locked therein by the respective lip.

An installer of beam 210 can take beam half 246 and position flange 258 over flange 278 of beam half 248 while simultaneously positioning flange 260 adjacent to flange 280. By overlying the beam half sections 246,248, the end of flange 278 abuts against nesting lip/receptacle 274,276 while flange 260 abuts against nesting lip/receptacle 286,288. Further, the end of flange 258 abuts against nesting lip/receptacle 290,292 while flange 280 abuts against nesting lip/receptacle 294,296, and allows the installer to easily position the beam half sections together.

As mentioned above, U-shaped receptacles 266,268 are formed between two inwardly facing prongs 270,272 and the respective wall 246 of the beam for receiving one end of a connection plate (not illustrated). The aforementioned connecting plates slid into U-shaped receptacles 266,268 allow beam 210 to be connected to an axially adjacent beam. Additionally, although not illustrated, respectively adjacent flanges 258,278,260,280 of beam half sections 246,248 may be secured together by screwing fastener screws therethrough.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A beam assembly for defining a portion of a frame of a screened enclosure, comprising:

a first longitudinal half beam section having a first exterior flange, a first interior flange, and first main portion connecting the first exterior flange to the first interior flange;

a first interior lip connected to an inside portion of the first exterior flange, and forming a first interior receptacle with the first exterior flange;

a first exterior lip connected to an outside portion of the first interior flange, and forming a first exterior receptacle with the first interior flange;

a second longitudinal half beam section having a second interior flange, a second exterior flange, and second main portion connecting the second interior flange to the second exterior flange;

a second exterior lip connected to an exterior portion of the second interior flange, and forming a second exterior receptacle with the second interior flange;

a second interior lip connected to an interior portion of the second exterior flange, and forming a second interior receptacle with the second exterior flange;

wherein a free end edge of the first exterior flange of the first longitudinal half beam is received in and restrained by the second exterior receptacle of the second longitudinal half beam while a free end edge of the first interior flange of the first longitudinal half beam is inserted into the second interior receptacle of the second longitudinal half beam, and wherein a free end edge of the second interior flange of the second longitudinal half beam is received in and restrained by the first interior receptacle of the first longitudinal half beam section while a free end edge of the second exterior flange of the second longitudinal half beam section is inserted into the first exterior receptacle of the first longitudinal half beam section, wherein said first exterior flange and said second exterior flange each define a step surface for engaging said respective exterior lip, and wherein each said step surface is defined by a rib, the rib projects outwardly from the respective flange so as to have first and second lateral sides, one of which defines said step surface, and an outer surface substantially coplanar with an outer surface of the respective exterior lip, and the rib has a width between said first and second lateral sides that is substantially less than a corresponding dimension of said respective exterior flange.

2. The internal support arrangement of claim 1, wherein at least one of the first longitudinal half beam and the second longitudinal half beam includes:

a pair of triangular shaped prongs facing one another and defining respective U-shaped receptacles.

3. The beam assembly of claim 1, wherein said first interior lip and said second interior lip each extend generally in parallel to said respective flange.

4. The beam assembly of claim 1, wherein an interior surface of said first exterior flange and an interior surface of said second exterior flange is grooved and wherein an exterior surface of said first interior flange and an exterior surface of said second interior flange is grooved so that said respective grooved surfaces engage when said respective free end edges of said flanges are received in said respective receptacles.

5. A beam assembly for defining a portion of a frame of a screened enclosure, comprising:

a first longitudinal half beam section having a first upper flange, a first lower flange, and first main portion connecting the first upper flange to the first lower flange;

a first interior lip connected to an inside portion of the first upper flange, and forming a first interior receptacle with the first upper flange;

a first exterior lip connected to an outside portion of the first lower flange, and forming a first exterior receptacle with the first lower flange;

a second longitudinal half beam section having a second upper flange, a second lower flange, and second main portion connecting the second upper flange to the second lower flange;

a second exterior lip connected to an exterior portion of the second upper flange, and forming a second exterior receptacle with the second upper flange;

a second interior lip connected to an interior portion of the second lower flange, and forming a second interior receptacle with the second lower flange;

wherein a free end edge of the first upper flange of the first longitudinal half beam is received in and restrained by the second exterior receptacle of the second longitudinal half beam while a free end edge of the first lower flange of the first longitudinal, half beam is inserted into the second interior receptacle of the second longitudinal half beam, and wherein a free end edge of the second upper flange of the second longitudinal half beam is received in and restrained by the first interior receptacle of the first longitudinal half beam section while a free end edge of the second lower flange of the second longitudinal half beam section is inserted into the first exterior receptacle of the first longitudinal half beam section, wherein said first interior lip and said second interior lip are each inwardly angled, wherein said first upper flange and said second lower flange each define a step surface for engaging said respective exterior lip, and wherein each said step surface is defined by a rib, the rib projects outwardly from the respective flange so as to have first and second lateral sides, one of which defines said step surface, and an outer surface substantially coplanar with an outer surface of the respective exterior lip, and the rib has a width between said first and second lateral sides that is substantially less than a corresponding dimension of said respective flange.

6. The beam assembly of claim 5, wherein the interior lips are respectively angled away from their respective flange.

7. A beam assembly for defining a portion of a frame of a screened enclosure, comprising:

a first longitudinal half beam section having a first exterior flange, a first interior flange, and first main portion connecting the first exterior flange to the first interior flange;

a first interior lip connected to an inside portion of the first exterior flange, and forming a first interior receptacle with the first exterior flange;

a first exterior lip connected to an outside portion of the first interior flange, and forming a first exterior receptacle with the first interior flange, an inner surface of said first exterior lip being tapered so that an entry end of said first exterior receptacle is enlarged;

a second longitudinal half beam section having a second interior flange, a second exterior flange, and second main portion connecting the second interior flange to the second exterior flange;

a second exterior lip connected to an exterior portion of the second interior flange, and forming a second exterior receptacle with the second interior flange, an inner surface of said second exterior lip, being tapered so that an entry end of said second exterior receptacle is enlarged;

a second interior lip connected to an interior portion of the second exterior flange, and forming a second interior receptacle with the second exterior flange;

wherein a free end edge of the first exterior flange of the first longitudinal half beam is received in and restrained by the second exterior receptacle of the second longitudinal half beam while a free end edge of the first interior flange of the first longitudinal half beam is inserted into the second interior receptacle of the second longitudinal half beam, and wherein a free end edge of the second interior flange of the second longitudinal half beam is received in and restrained by the first interior receptacle of the first longitudinal half beam section while a free end edge of the second exterior flange of the second longitudinal half beam section is inserted into the first exterior receptacle of the first longitudinal half beam section, wherein said first exterior flange and said second exterior flange each define a step surface for engaging said respective exterior lip, and wherein each said step surface is defined by a rib, the rib projects outwardly from the respective flange so as to have first and second lateral sides, one of which defines said step surface, and an outer surface substantially coplanar with an outer surface of the respective exterior lip, and the rib has a width between said first and second lateral sides that is substantially less than a corresponding dimension of said respective exterior flange.

8. The beam assembly of claim 7, wherein at least one of the first longitudinal half beam and the second longitudinal half beam includes:

a pair of triangular shaped prongs facing one another and defining respective U-shaped receptacles.

9. The beam assembly of claim 7, wherein said first interior lip and said second interior lip are each inwardly angled.

10. The beam assembly of claim 7, wherein an interior surface of said first exterior flange and an exterior surface of said second exterior flange is grooved and wherein an exterior surface of said first interior flange and an interior surface of said second interior flange is grooved so that said respective grooved surfaces engage when said respective free end edges of said flanges are received in said respective receptacles.

* * * * *